US005282422A

United States Patent [19]

Borgström et al.

[11] Patent Number: 5,282,422

[45] Date of Patent: Feb. 1, 1994

[54] SUB-COMBAT UNIT

[75] Inventors: Dan Borgström, Karlskoga; Lasse Karlsen, Lidingö; Lars Paulsson, Kristinehamn, all of Sweden

[73] Assignee: Bofors AB, Karlskoga, Sweden

[21] Appl. No.: 957,487

[22] Filed: Oct. 7, 1992

[51] Int. Cl.[5] ..... F42B 10/50

[52] U.S. Cl. ..... 102/384; 102/388; 244/327

[58] Field of Search ..... 244/3.27, 3.28, 3.29; 102/386, 388, 393, 489, 384, 387, 476

[56] References Cited

U.S. PATENT DOCUMENTS

| | | | |
|---|---|---|---|
| H685 | 10/1989 | Olson et al. | 244/3.29 |
| 1,626,363 | 4/1927 | Sperry | 102/384 |
| 2,446,279 | 8/1948 | Hammond | 102/384 |
| 2,520,665 | 8/1950 | Warren | 102/384 |
| 2,784,669 | 3/1957 | Apothéloz et al. | 244/3.29 |
| 4,004,514 | 1/1977 | Daniels | 244/3.29 |
| 4,143,836 | 3/1979 | Rieger | 244/3.15 |
| 4,492,166 | 1/1985 | Purcell | 102/384 |
| 4,858,532 | 8/1989 | Persson et al. | 102/387 |
| 4,966,078 | 10/1990 | Schleimann-Jensen | 102/384 |
| 5,063,849 | 11/1991 | Axinger | 102/388 |
| 5,067,410 | 11/1991 | Murnane et al. | 102/489 |
| 5,088,414 | 2/1992 | Vesa | 102/388 |
| 5,155,294 | 10/1992 | Vesa | 102/384 |

FOREIGN PATENT DOCUMENTS

| | | |
|---|---|---|
| 0252036 | 3/1987 | European Pat. Off. . |
| 0451123 A1 | 3/1991 | European Pat. Off. . |

OTHER PUBLICATIONS

Langley Research Center, Hampson, Va., NTIS Tech Notes, No. 2301, Jun. 91, Springfield, Va., USA, p. 523, XP000240005, Wilson & Lance, "Leading Edge Pop-Up Spoiler for Airfoil".

*Primary Examiner*—David H. Brown

*Attorney, Agent, or Firm*—Pollock, Vande Sande & Priddy

[57] ABSTRACT

A sub-combat unit to be separated from a flying body, comprises a warhead, a target detector and two diametrically disposed carrier surfaces designed and arranged to impart to the sub-combat unit a rotation for scanning of the target area in a helical pattern during the fall of the sub-combat unit down towards the target area. The two carrier surfaces are pivotable between a closed position and an opened position in which the two carrier surfaces form a retarding area for controlling the fall velocity of the sub-combat unit and a flow influencing means is provided at at least one of the two carrier surfaces for creating a turbulent area immediately above the carrier surface for completely relieving the carrier surfaces even for large differences in the direction of the impinging wind.

6 Claims, 2 Drawing Sheets

SUB-COMBAT UNIT

TECHNICAL FIELD

The present invention relates to a sub-combat unit disposed to be separated from a flying body, for example a carrier shell or the like, over a target area, the sub-combat unit comprising a warhead, a target detector and a device which imparts to the sub-combat unit a rotation for scanning the target area in a helical pattern during the fall of the sub-combat unit towards the target area. One such sub-combat unit has been previously described in Swedish patent specification 8601423-0 corresponding to U.S. Pat. No. 4,858,532.

BACKGROUND OF THE INVENTION

The characterizing features of the sub-combat unit described in the above-mentioned patent are that the target detector is pivotally disposed on a journal shaft which is parallel to the line of symmetry of the warhead so as to permit outward pivoting of the target detector from a closed position where the optical axis of the target detector coincides with the line of symmetry of the warhead, to an opened position where the optical axis of the target detector is parallel to the line of symmetry of the warhead to permit a free view of the target detector beside the warhead. In addition, a carrier surface is pivotally disposed on a journal shaft which is also parallel to the line of symmetry of the warhead so as to permit outward pivoting of the carrier surface from a closed position to an opened position beside the warhead.

By a suitable aerodynamic design of the sub-combat unit and the retarding area of the detector and carrier surface, there will be obtained a suitable fall velocity of the sub-combat unit and further an impelling moment about the spinning axis which gives the sub-combat unit its rotation. This is achieved without the aid of a parachute, which is an advantage since the parachute is bulky and requires space. Therefore, more space in a carrier shell can instead be made available for the warhead proper.

Even thought the above-described sub-combat unit has proved to possess superior properties with respect to fall velocity and scanning rotation, it has been desired in the art to increase the retarding area even further. This may, for instance, be the case when it is desired to employ heavier warheads. The retarding area of the target detector and carrier surface is restricted to the cross-sectional area of the cylindrical sub-combat unit body, which may entail that the fall velocity will become too high with the existing size of the retarding area if, at the same time, the weight of the warhead is increased.

Swedish patent application number 8903474-8 corresponding to U.S. Pat. No. 5,088,414 describes a sub-combat unit in which the retarding area has been made considerably larger. The characterizing feature of the sub-combat unit is that two diametrically located carrier surfaces are pivotally disposed each on its own shaft located in a plane which is at right angles to the axis of symmetry of the warhead, and pivotable from a closed position where the carrier surfaces follow the casing surface of the sub-combat unit, to a 90° opened position where both of the carrier surfaces form a retarding area for the fall velocity of the sub-combat unit.

In this case, the carrier surfaces are made of an elastically flexible material, so that, when they pivot out from their closed position, they are at the same time bent to a substantially straight or gently curved surface.

The advantage inherent in the above-described design, in addition to the larger retarding area, is that both of the carrier surfaces may be made comparatively thin, which is favorable from the point of view of weight and payload. For example, the carrier surfaces may be made of titanium and bent so that, in their opened position, they have a certain radius. The bending may be varied and the carrier surfaces may be of different lengths, in which event further parameters for varying the aeronautical properties of the unit will be obtained.

Even if the two carrier surfaces are designed with an accurately specified geometry in accordance with known ballistical laws, it may occur at certain angles of wind impingement in relation to the carrier surface that the momentaneous is disturbed, so that a disturbance (unwanted pendulum motion, instability) occurs in the sub-combat unit to the detriment of the scanning movement.

SUMMARY OF THE INVENTION

The object of the present invention is therefore to further improve the flight properties of a sub-combat unit of the aforesaid kind and specifically to design the sub-combat unit so that as uniform and stable a scanning movement as possible will be obtained without instabilities.

According to the present invention the carrier surfaces have been given such a configuration that the flow around the carrier surfaces will be completely relieved even for large differences in the direction of wind impingement.

By allowing the carrier surfaces to include, for example, special devices, completely relieved flow of the carrier surface can be obtained for virtually all angles of wind impingement in relation to the carrier surface. Relieved flow of the carrier surface has been achieved even earlier, but at certain angles of wind impingement in relation to the carrier surface so-called "wind profile flow" has been able to occur, which has led to a "jump" in the moment curve, resulting in pendulum motion (instability) of the sub-combat unit.

BRIEF DESCRIPTION OF THE DRAWINGS

The present invention will be described in greater detail hereinbelow with particular reference to the accompanying Drawings which illustrate some examples of how a sub-combat unit according to the present invention can be designed. In the accompanying Drawings.

DETAILED DESCRIPTION OF THE PREFERRED EMBODIMENT

Figure 1:
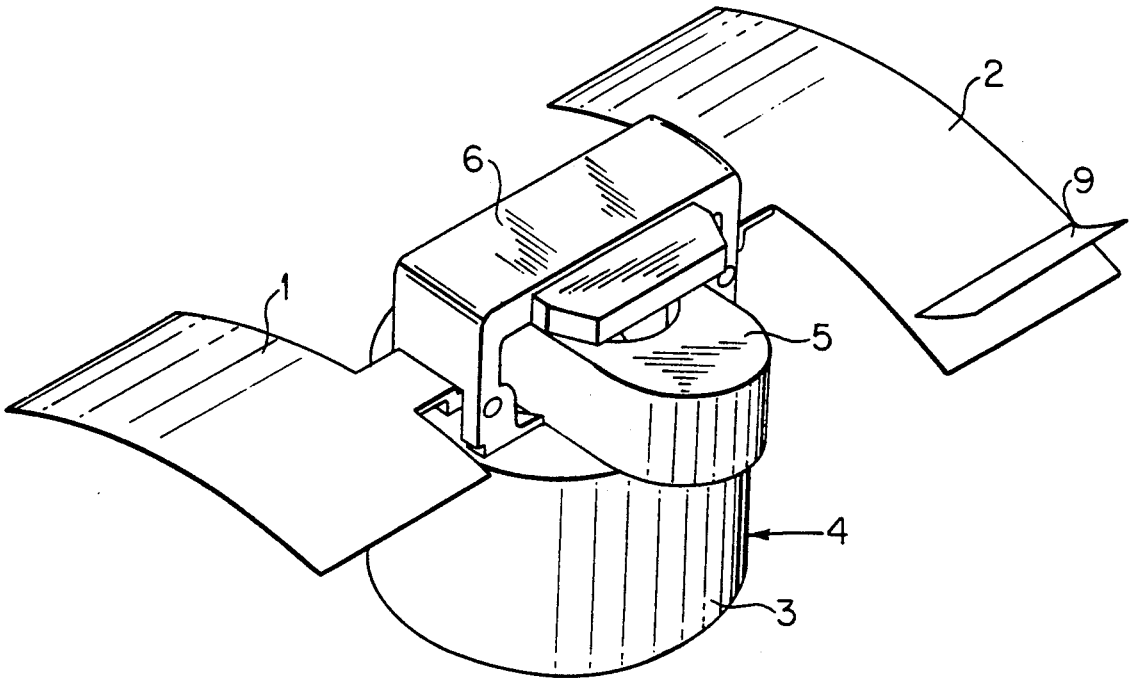
FIG. 1 shows the sub-combat unit in its opened position, one of the two carrier surfaces being provided with a device according to the present invention to achieve, completely relieved flow of the carrier surface.

The sub-combat unit is assumed to have been separated from a canister in a carrier shell. The carrier shell may, for instance, be of 15.5 cm caliber and have been discharged from a field gun in a conventional manner in a ballistic trajectory towards a target area. In order to impart to the sub-combat unit a controlled scanning movement of the target area, that is a controlled rotation and fall velocity, two diametrically disposed carrier surfaces 1, 2 are pivoted from a closed position in which the carrier surfaces follow the casing surface 3 of the sub-combat unit to an opened position where both of the carrier surfaces form a retarding area. (See FIG. 1 and 2).

The sub-combat unit comprises a warhead 4 and a target detector 5 which is arranged to be movable from a closed position in a stirrup-like superstructure 6 on the warhead to an opened position where it has free view beside the warhead. The warheads and the target detector are of known type and will not, therefore, be described in greater detail here.

The actual carrier surfaces 1,2 and their suspension may be elaborated in the manner described in Swedish Patent Specification 8903474-8 corresponding to U.S. Pat. No. 5,088,414 mentioned by way of introduction, or according to Swedish Patent Specification 9001227-9 corresponding to U.S. Pat. No. 5,155,294.

To impart a uniform and stable motion to the sub-combat unit the two carrier surfaces 1,2 have been trimmed in relation to each other and given an accurate geometrical configuration. By this means the inherent movements of the sub-combat unit (nutation and precession movements) can be damped and a suitable fall speed and rotational speed be obtained.

Figure 4A:
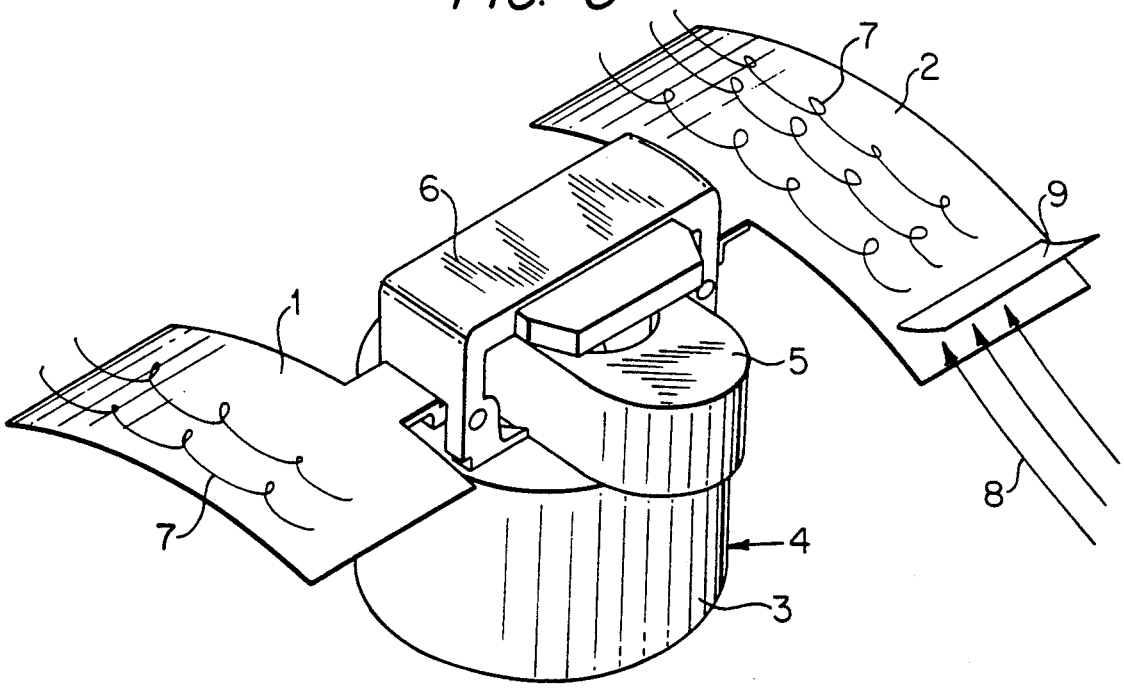
FIGS. 4A, 4B show schematically the flow conditions around a carrier surface.
Figure 4B:
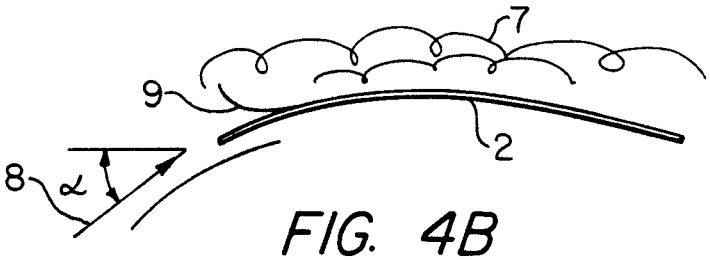

When the sub-combat unit has attained a uniform and stable motion a turbulent area 7 occurs immediately above the two carrier surfaces (see FIGS. 4A and 4B) so called relieved flow, as opposed to the wing profile flow on the underside of the carrier surface. This favorable circumstance shall be retained for a varying number of angles of air impingement in relation to the carrier surface, indicated by the arrows 8. To enable this, at least one of the two carrier surfaces has been provided with a flap-like extended wing 9 which extends essentially over the width of the carrier surface and which has been welded along one of its long sides to the upper side of the carrier surface at its one end. The wing 9 prevents possible wing profile flow on the upper side of the carrier surface.

Figure 3:
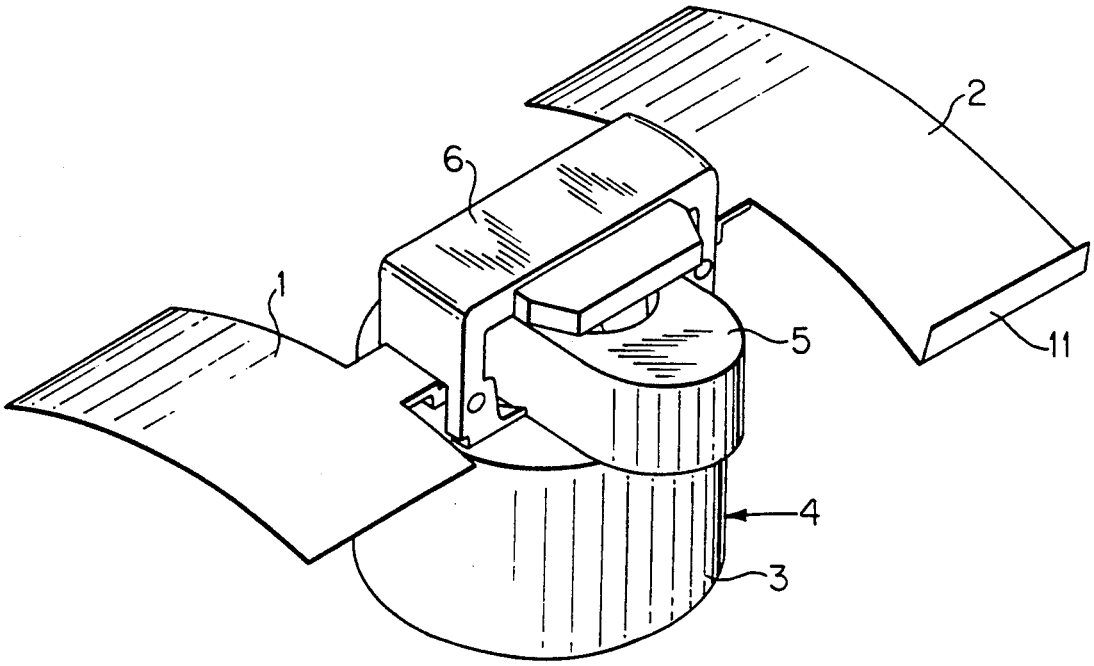
FIG. 3 shows a third embodiment of the device.

Like the two carrier surfaces, the wing 9 is comparatively thin and preferably made of titanium, which is elastically flexible so that the wing rests against the upper side of the carrier surface in the closed position of the carrier surfaces when these, in turn, follow the casing surface of the sub-combat unit, but in the opened position of the carrier surfaces easily spring up to the position shown in FIGS. 1 and 3, that is a slightly bent surface which forms an angle of about 90° with the carrier surface.

Through the design of the wing flap and its location on the upper side of the carrier surface it functions as a "whirl generator" which gives turbulence on the upper side of the carrier surface (completely relieved flow).

Figure 2:
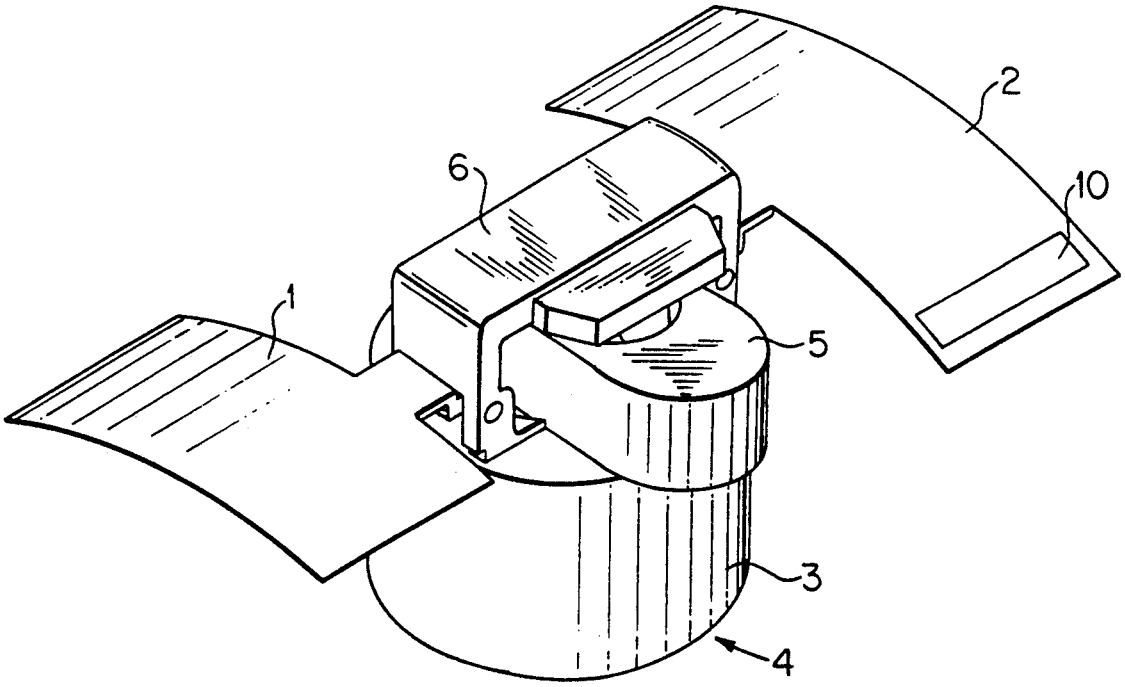
FIG. 2 shows a second embodiment of the device.

Shown in FIG. 2 is a second embodiment which permits to achieve the desired turbulence. In this case an oblong hole 10 has been made in the carrier surface in the vicinity of one end thereof. Air enters through this hole and flows out onto the upper side of the carrier surface, providing the desired completely relieved flow. Such a hole is naturally advantageous from the standpoint of weight and does not increase the thickness of the carrier surface.

FIG. 3 shows a third embodiment in which the actual carrier surface 2 has an angled end portion 11 with a height of 5–10 mm which forms a largely right angle to the plane of the carrier surface.

One advantage of the wing flap 9 or an angled end portion 11 is that apart from the relieved flow this also imparts some roll damping to the sub-combat unit. Because a rapid increase in the speed of rotation to a steady-state speed is wanted for the scanning movement, it is advantageous if a damping effect of the roll movement can be achieved.

The present invention should not be considered as restricted to the two examples of devices described above to achieve the completely relieved flow, many modifications being conceivable without departing from the spirit and scope of the appended claims.

What we claim and desire to secure by Letters Patent is:

1. A sub-combat unit to be separated from a flying body, comprising a warhead, a target detector and two diametrically disposed carrier surfaces designed and arranged to impart to the sub-combat unit a rotation for scanning of the target area in a helical pattern during the fall of the sub-combat unit down towards the target area, the two carrier surfaces being pivotable between a closed position and an opened position in which the two carrier surfaces form a retarding area for controlling the fall velocity of the sub-combat unit and a flow influencing means provided at at least one of the two carrier surfaces for creating a turbulent area immediately above the carrier surface for completely relieving the carrier surfaces even for large differences in the direction of the impinging wind.

2. A sub-combat unit as claimed in claim 1, wherein said flow influencing means includes at least one aperture made in the carrier surface in the vicinity of one end thereof.

3. A sub-combat unit as claimed in claim 1, wherein said flow influencing means includes a narrow angled end portion of the carrier surface.

4. A sub-combat unit as claimed in claim 1, wherein said flow influencing means includes a wing-like flap mounted on the upper side of the carrier surface in the vicinity of one end thereof.

5. A sub-combat unit as claimed in claim 4, wherein the flap is made of an elastically flexible material, so that in the closed position of the carrier surfaces the said flap is adapted to connect to the upper side of the carrier surface, but in the opened position easily springs out and forms a gently curved surface.

6. A sub-combat unit as claimed in claim 4, wherein said flexible material is titanium.

* * * * *